United States Patent [19]

Klamer

[11] 4,291,881

[45] Sep. 29, 1981

[54] KALEIDOSCOPIC GAME DEVICE

[76] Inventor: Reuben B. Klamer, 969 Hilgard Ave., Los Angeles, Calif. 90024

[21] Appl. No.: 91,052

[22] Filed: Nov. 5, 1979

[51] Int. Cl.[3] ..... A63F 5/04

[52] U.S. Cl. ..... 273/142 H

[58] Field of Search ..... 273/142 H, 142 HA, 142 R, 273/142 A, 142 B, 142 C, 142 D, 142 E, 142 F, 142 G, 142 J, 142 JA, 142 JB, 142 JC, 142 JD, 142 K; 35/74

[56] References Cited

U.S. PATENT DOCUMENTS

| | | | |
|---|---|---|---|
| 474,188 | 5/1892 | Rabiger et al. | 273/142 H |
| 636,508 | 11/1899 | Eickershoff | 273/142 H X |
| 2,193,896 | 3/1940 | Angst | 273/142 F |
| 2,565,557 | 8/1951 | Guimond | 273/142 HA |
| 3,046,018 | 7/1962 | Serpico | 273/142 JB |
| 3,149,844 | 9/1964 | Di Carlo | 273/142 R X |
| 3,243,185 | 3/1966 | Miller | 273/142 R |
| 3,628,795 | 12/1971 | Hopkins | 35/74 X |

FOREIGN PATENT DOCUMENTS

| | | | |
|---|---|---|---|
| 109106 | 11/1939 | Australia | 273/142 R |
| 372314 | 3/1923 | Fed. Rep. of Germany | 273/142 R |
| 174692 | 2/1934 | Switzerland | 273/142 H |
| 9056 | of 1889 | United Kingdom | 273/142 H |
| 406027 | 2/1934 | United Kingdom | 273/142 HA |

*Primary Examiner*—Richard C. Pinkham
*Assistant Examiner*—Arnold W. Kramer
*Attorney, Agent, or Firm*—Lyon & Lyon

[57] ABSTRACT

A device for the generation of randomly selected numbers or other data. A plurality of small numbered wheels rest upon the surface of a larger base wheel. The larger base wheel is journaled upon a needle in a circular housing. Snap rings retain the base wheel and the smaller numbered wheel within the circular housing. Random data is generated by spinning the base wheel in either direction. The torque of this motion causes the smaller numbered wheels to spin in the opposite direction. When both the base wheel and smaller numbered wheels come to rest, a centrally located indicator determines the number or data selected.

5 Claims, 3 Drawing Figures

KALEIDOSCOPIC GAME DEVICE

BACKGROUND OF THE INVENTION

Devices to randomly select numbers or other data have been utilized in games throughout the history of mankind. Dice and simple spinners are commonly used for this purpose. However, due to the simplicity of these and other such devices, they are capable of producing only a limited array of data. Therefore, the need exists in the art for a device for the generation of random data which has the capability of producing a sufficiently large array of data, and which does so in a visually pleasing manner.

The present invention accomplishes these goals. The plurality of numbered wheels provide a large data bank from which numbers or data may be randomly selected. The spining motion of the numbered wheels juxtaposed with the motion of the base wheel provide a kaleidoscopic effect which is visually very pleasing.

Therefore, it is the object of this invention to provide an improved device for the generation of randomly selected numbers or other data.

Another object of the present invention is to provide a device for the generation of randomly selected numbers which does so in the manner in which it is visually pleasing.

Still another specific object of the present invention to provide a device for the generation of randomly selected data which has a sufficiently large data bank from which said numbers may be selected.

Other objects and purposes of the invention will be apparent to those skilled in the art from the reading of the appended description of the preferred embodiment and claims.

DETAILED DESCRIPTION OF THE PREFERRED EMBODIMENT

Figure 1:
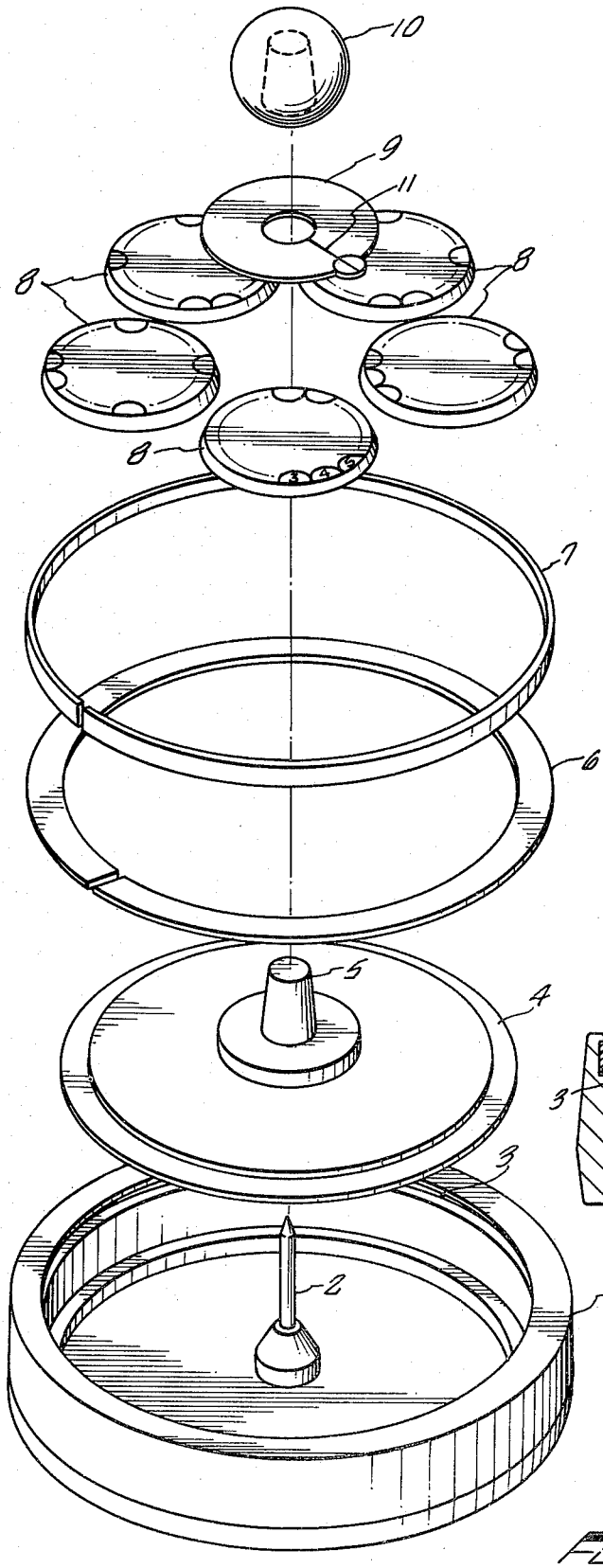
FIG. 1 is an exploded perspective view of the invention.
Figure 2:
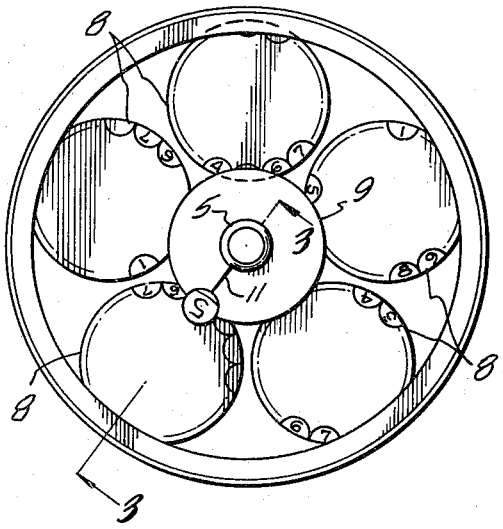
FIG. 2 is a top view of the assembled invention.
Figure 3:
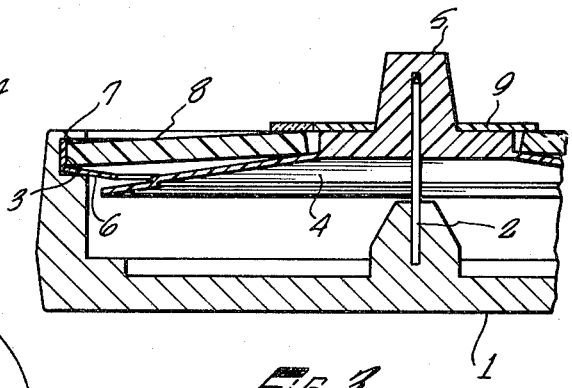
FIG. 3 is a side view taken in cross-section along line 3—3 of FIG. 2.

The device may be constructed of wood or plastic or any other material which is durable and resistent to wear.

Circular housing 1 is closed at a first end and open at a second end. The bottom closed end is equipped with needle assembly 2 which extends vertically upward from the bottom of circular housing 1 at the center point thereof. Circular housing 1 is equipped with an upper recessed portion 3. Base wheel 4 is slightly conical in shape. It is fitted with handle 5 which is located at the center of said base wheel 4 and extends vertically thereabove. The size of the base wheel 4 is such that it fits within the circular housing 1. There is a small hole in the center of base wheel 4 which extends from the underside thereof up into handle 5 but does not extend therethrough thereby allowing base wheel 4 to be mounted upon needle assembly 2. Base wheel 4 is freely rotatable upon needle assembly 2. When so disposed upon needle assembly 2 the outer edge of base wheel 4 is positioned in circular housing 1 at a point just below recessed portion 3. Snap ring 6 is positioned within recessed portion 3 such that it provides surface continuity from recessed portion 3 to base wheel 4. Snap ring 7 is positioned in recessed portion 3 to retain snap ring 6 in position. Numbered wheels 8 are placed within circular housing 1 such that one outer point of each wheel 8 rests against snap ring 7 and upon snap ring 6 within recessed portion 3 and the opposite point of each wheel 8 rests upon base wheel 4. A retainer/indicator 9 fits over the handle 5 to retain wheels 8 in their position against base wheel 4. Handle adaptor 10 slidably fits upon handle 5 to increase the size of the handle.

The operation, handle 5 or the adaptor 10 is grasped by the hand and spun in either direction thereby spinning base wheel 4. The torque created by this motion causes smaller numbered wheels 8 to spin in the opposite direction. Numbers or other data may be inscribed upon the small wheel 8. When the wheels 8 and base wheel 4 come to rest, the indicator portion 11 of retainer/indicator 9 will read off the number or data produced. Therefore, in operation, the motion of base wheel 4, the motion of numbered wheels 8, and the motion of retainer/indicator 9 work to randomly select the numbers or data produced.

In one embodiment of the present invention, smaller numbered wheels 8 are reversible and may be placed either side up on base wheel 4. This allows for different sets of data to be inscribed on the different side of wheels 8 to greatly increase the data bank from which random data may be generated.

It is to be understood that although in describing the preferred embodiment of this invention certain terms have been utilized, these terms are for description only and in no way limit the scope of this invention. That scope is limited only by the breadth of the appended claims.

What is claimed is:

1. A kaleidoscopic game device for the generation of randomly selected data, said device comprising a circular housing; a base wheel rotatable within said housing upon needle means attached to said housing; a recessed portion in said housing, said recessed portion located annularly about the interior periphery of said housing above said base wheel; a plurality of wheels having data thereon, said wheels having a diameter less than the radius of said base wheel, one edge of each said wheel resting in said recessed portion of said housing and the opposite edge of each said wheel resting on said base wheel such that each said wheel is freely confined and rotatable upon movement of said base wheel; and indicator means for selecting said data.

2. The invention of claim 1 further comprising snap ring means for providing surface continuity between said base wheel and said recessed portion of said housing.

3. The invention of claim 2 wherein said snap ring means comprises a horizontally disposed snap ring extending from said recessed portion of said housing to said base wheel.

4. The invention of claim 3 wherein said snap ring means further comprises a vertically displaced snap ring in said recessed portion of said housing, said vertically displaced snap ring situated above said horizontally disposed snap ring in said recessed protion of said housing.

5. A kaleidoscopic game device for generation of randomly selected numbers or data, said device comprising a circular housing, closed at a first end and open at a second end, a needle attached to and extending upwards perpendicularly from the center of said closed second end of said housing; an annular interior recessed portion in said housing; a base wheel journaled upon and freely rotatable about said needle; a horizontally disposed snap ring positioned within said recessed portion of said housing and extending therefrom to said base wheel, providing surface continuity between said base wheel and said recessed portion; a second, vertically displaced snap ring positioned in said recessed portion of said housing, about the upper periphery of said first horizontally disposed snap ring to maintain said first snap ring in position; a plurality of wheels, having data or numbers thereon, whose diameter is less than the radius of the base wheel and which rests one edge of each on said base wheel and the other edge of each within said recessed portion on said horizontally disposed snap ring, said numbered wheels being freely rotatable; and indicator means for selecting said numbers or data.

* * * * *